United States Patent [19]

Cattaneo

[11] Patent Number: 4,995,742

[45] Date of Patent: Feb. 26, 1991

[54] NEEDLE PRINTING HEAD

[75] Inventor: Sergio Cattaneo, Rho, Italy

[73] Assignee: Bull HN Information Systems, Inc., Billerica, Mass.

[21] Appl. No.: 415,811

[22] Filed: Oct. 2, 1989

[30] Foreign Application Priority Data

Oct. 18, 1988 [IT] Italy ..... 22341 A/88

[51] Int. Cl.[5] ..... B41J 2/27

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,896,918 | 7/1975 | Schneider | 400/124 |
| 4,244,658 | 1/1981 | Mori | 400/124 |
| 4,407,591 | 10/1983 | Adamoli et al. | 400/124 |
| 4,498,791 | 2/1985 | Gilbert | 400/124 |
| 4,674,896 | 6/1987 | Yasanuga et al. | 400/124 |

FOREIGN PATENT DOCUMENTS

| | | | |
|---|---|---|---|
| 228589 | 2/1986 | European Pat. Off. | 400/124 |
| 255148 | 7/1987 | European Pat. Off. | 400/124 |
| 217168 | 10/1985 | Japan | 400/124 |
| 61-865 | 3/1986 | Japan | 400/124 |
| 259871 | 11/1987 | Japan | 400/124 |

*Primary Examiner*—Edgar S. Burr
*Assistant Examiner*—Joseph R. Keating
*Attorney, Agent, or Firm*—Gary D. Clapp; John S. Solakian

[57] ABSTRACT

Needle printing head of the permanent magnet type where the armatures of a plurality of printing actuators are attracted, in rest position, against the poles of a permanent magnet and released in printing position by the "cancellation" of the magnetic flux caused by control windings and where the impact of the armatures against the permanent magnet poles, when they return to the rest position is damped by a multilayer element interposed between armatures and magnetic poles and consisting in two thin sheets of magnetic steel between which a thin film of resilient material such as polyester is interposed.

2 Claims, 2 Drawing Sheets

FIG. 3
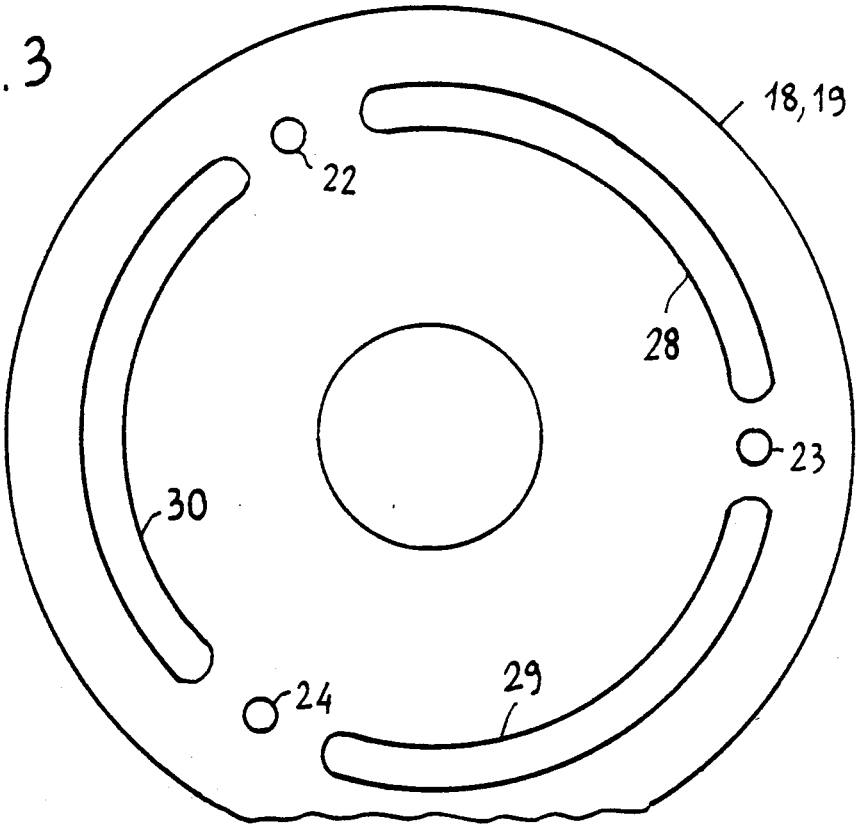
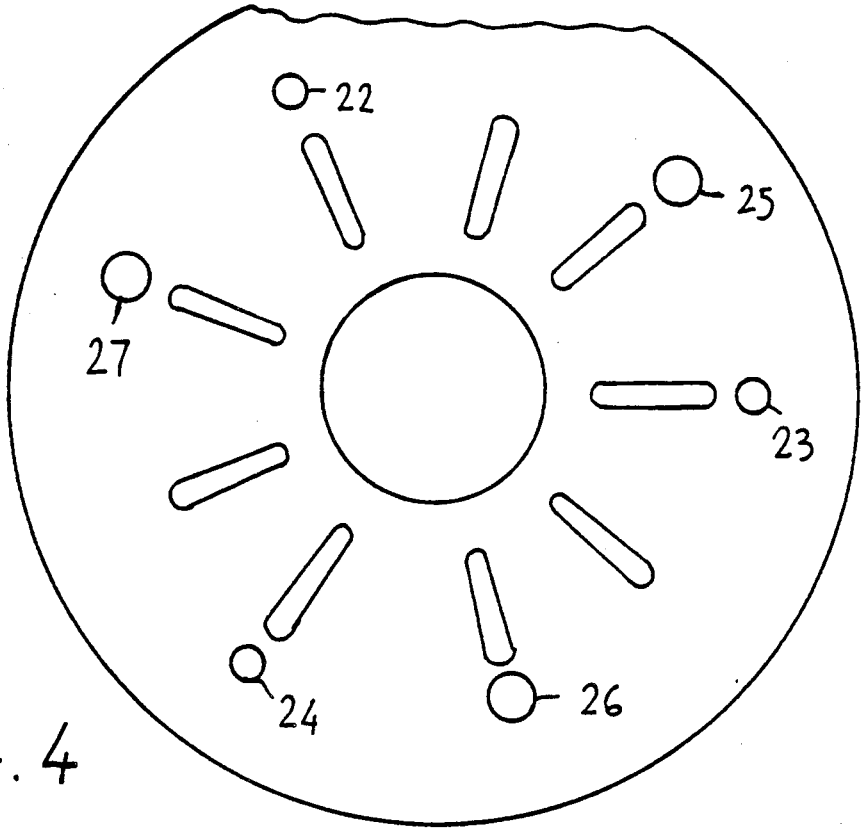
FIG. 4

NEEDLE PRINTING HEAD

BACKGROUND OF THE INVENTION

1. Field of Use

The present invention relates to a needle printing head of the permanent magnet type, where the armatures of a plurality of printing actuators are attracted, in rest position, against the poles of a permanent magnet and released to a printing position by the "cancellation" of the magnetic flux by control windings.

2. Prior Art

While such printing heads allow high operating speeds, a basic problem encountered in such printing heads results from the impact occurring between the armatures and the magnetic poles when the armatures return to the rest position.

This impact occurs when the kinetic energy of the armatures is at its maximum and causes bouncing and consequent armature oscillations, wearing of the contacting surfaces and very high internal stresses in the armature.

These internal stresses, which are of periodic nature due to the repetitive operation of the armature, cause fatigue failure of the armatures and limit their useful life.

Several systems for impact damping have been proposed.

The most common one is the use of a thin resilient sheet of polyester or equivalent material interposed between armatures and magnetic poles.

This element must be very thin in order not to cause relevant magnetizing force drop in the air gap so formed.

At the same time it must be capable of absorbing the mechanical stresses imparted by the movable armatures.

Experience shows that this arrangement, however effective, has a very limited life compared to the desired operational life of the printing head.

The resilient sheet is subjected to repeated compression, which is not distributed in a uniform or controllable manner and is worn and torn, so that the sheet ceases to perform the required damping.

These disadvantages are overcome by the permanent magnet needle printing head of the invention.

SUMMARY OF THE INVENTION

In the printing head of the invention, damping of the impact between the movable armatures and the cores of the permanent magnet is obtained by adopting a sandwich composite laminar structure comprising two thin metal sheets, preferably of magnetic steel, between which a thin polyester sheet is interposed.

This structure extends beyond the limited contacting surfaces between armatures and magnetic poles and forms a unitary assembly which can be easily mounted and which encompasses the whole assembly of armatures and magnetic poles.

It has been found that by adopting such structure the wearing and tearing phenomena of the damping element are substantially eliminated and it becomes possible to achieve a useful print head life in the order of hundreds of millions of printed characters.

In addition, the metal sheets which protect the resilient sheet, perform a magnetic shunting action which increases the release speed of the armature, without affecting the return phase in a negative way.

DESCRIPTION OF THE DRAWINGS

The features and the advantages of the invention will appear more clearly from the following description of a preferred form of embodiment and from the enclosed drawings where

FIGS. 2 and 3 show in top view, as related to FIG. 1, the elements forming a sandwich damping structure for the print head of FIG. 1; and, FIG. 4 shows in top view a variant of the element of FIG. 3.

DESCRIPTION OF THE PREFERRED EMBODIMENT

Figure 1:
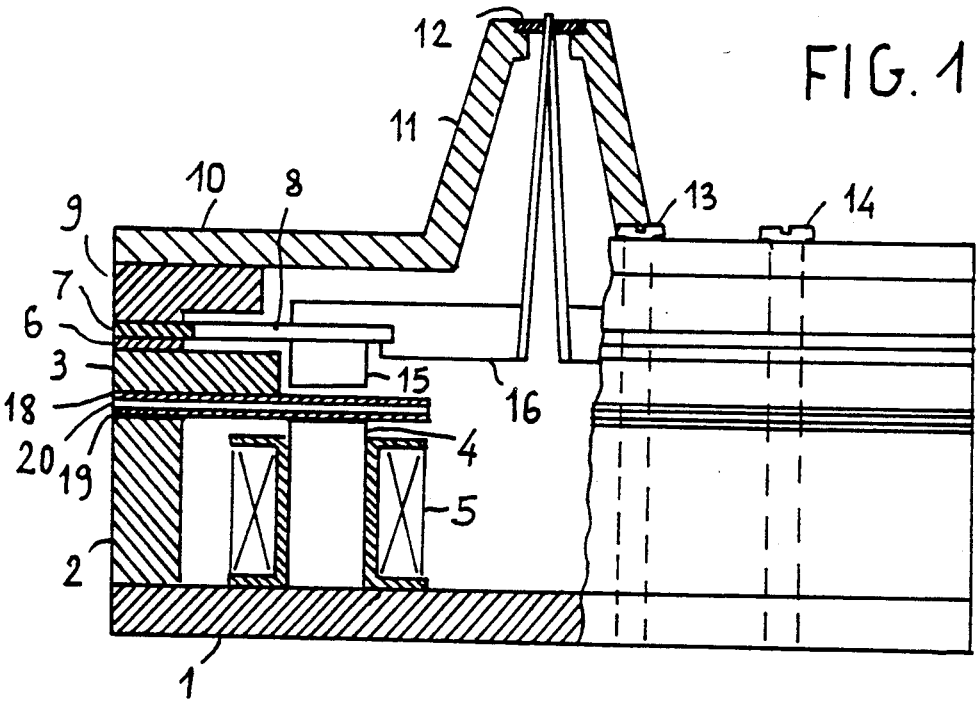
FIG. 1 shows partially in section view, a preferred embodiment of print head according to the invention.

FIG. 1 shows partially in section view, a preferred embodiment of print head according to the invention.

The print head comprises a base circular plate made of magnetic material, a magnetic toroidal ring 2 which is axially magnetized, a toroidal ring 3 made of magnetic material, and a plurality of cylindrical magnetic cores radially arranged around the central axis of the print head.

A coil is inserted on each of the magnetic cores. One of the cores and the corresponding coil are shown in FIG. 1 where they are referenced by numerals 4 and 5 respectively.

The printing head further comprises a thin circular ring 6 of magnetic material and a further circular ring 7 in material which is both magnetic and elastic, such as steel.

Ring 7 is provided with a plurality of elastic leaves which extend inwardly towards the central axis of the print head.

The number of leaves is equal to the number of cylindrical cores and each leaf is radially aligned with a corresponding cylindrical core.

FIG. 1 shows one of such leaves, referenced by numeral 8.

The print head further comprises a circular ring 9 for retaining ring 7 and a closing lid 10 having a nose on the end of which a needle guiding element 12, made, for example, of ruby, is mounted.

The various elements 1, 2, 3, 6, 7, 8, 9 are rigidly packed one over the other so as to form a unitary assembly held together by screws inserted in suitable seats.

Two screws 13, 14 are shown with dashed lines in FIG. 1.

Each of the elastic leaves 8 is provided with a cylindrical post 15, made of magnetic material and axially aligned with a corresponding cylindrical core 4.

Each leaf 8 further has an actuation arm 16 with a free end to which a printing needle is mounted.

The various cores 4, plate 1 and rings 2, 3, 6, and 7, form a plurality of magnetic circuits, each closed by a movable armature formed by an elastic leaf 8 and a post 15.

In the absence of magnetic forces, the elastic leaves 8 extend perpendicularly to the print head axis and an air gap, in the order of 0.3 mm, is present between the lower face or pole of the posts 15 and the upper face of the magnetic cores 4.

However, due to the magnetic field developed by permanent magnet 3, the elastic leaves 8 are normally bent and attracted towards the poles of the cores 4 and the posts 15 are in contact with the cores 4.

The selective energization of the several coils 5 act to selectively demagnetize the various magnetic circuits and to selectively release the various leaves 8, so that the corresponding printing needles are actuated to perform the printing operation.

When the various coils 5 are deenergized and the magnetic field is reestablished, the various armatures consisting of leaves 8 and posts 15 are attracted towards the magnetic cores 4 poles of the, the posts 15 impacting against the cores 4.

This impact causes mechanical stresses in the actuation arms 16, which tend to bend as a result of their inertia, and ultimately fail by fatigue.

Also, posts 15 tend to rotate around a contact point on cores 4, with consequent wear.

These phenomena are further complicated by the occurrence of bouncing.

According to the invention the above described structure is improved by interposing a multiple layer sandwich, damping element between the poles of the magnetic poles 4 and the upper side of toroidal ring 2 on one side and the lower face of ring 3 and the lower face of posts 15 on the other side.

The multiple layer element comprises two thin steel sheets 18 and 19, between which is interposed a thin resilient sheet 20, preferably in polyester resin and continuously in contact with the outer steel sheets.

In a preferred embodiment, the total thickness of the three sheets is on the order of 0.09 mm and each sheet has a thickness in the order of 0.03 mm. The two outer sheets are in magnetic steel having a substantial hardness, such as is provided by AISI R51 steel.

A multilayer element of the type described has proved to be particularly effective for damping the impact of the armatures (and more properly of the posts 15) against the poles of the magnetic cores 4, which impact occurs through the sandwich.

As a consequence, stresses in the actuation arms and bouncing are greatly reduced while the wear and tearing of the polyester film is avoided due to the protection provided by outer steel sheets.

In addition, the release speed of the armature from the magnetic core is increased, while the return is not substantially affected.

This phenomena is due not only to the magnetic force drop caused in the air gap formed by the polyester film, but to factors resulting from the following.

The thin steel sheets 18, 19, which protect the polyester film and which extend from the pole of each magnetic core 4 to the poles contiguous thereto on one side and so as to be interposed between the permanent magnet 2 and the toroidal ring 3 on the other, form a magnetic shunt for the flux generated by the permanent magnet.

This magnetic shunt has a very small useful section as a path for the magnetic flux and therefore is saturated and diverts a minimum amount of the magnetic flux generated by the permanent magnet.

It therefore has a negligible effect on the attractive force exerted on the armature by the magnetic flux.

However, when the winding associated with a magnetic core is energized to cancel the magnetic flux, the energization causes only a relative reduction in the magnetic flux, not a full neutralization.

The residual flux which, however small, opposes the elastic return force of the armature and hence its release, is contained to certain extent in the shunt path, holding the path in saturation, and only in part exerts a braking action on the movable armature.

Figure 2:
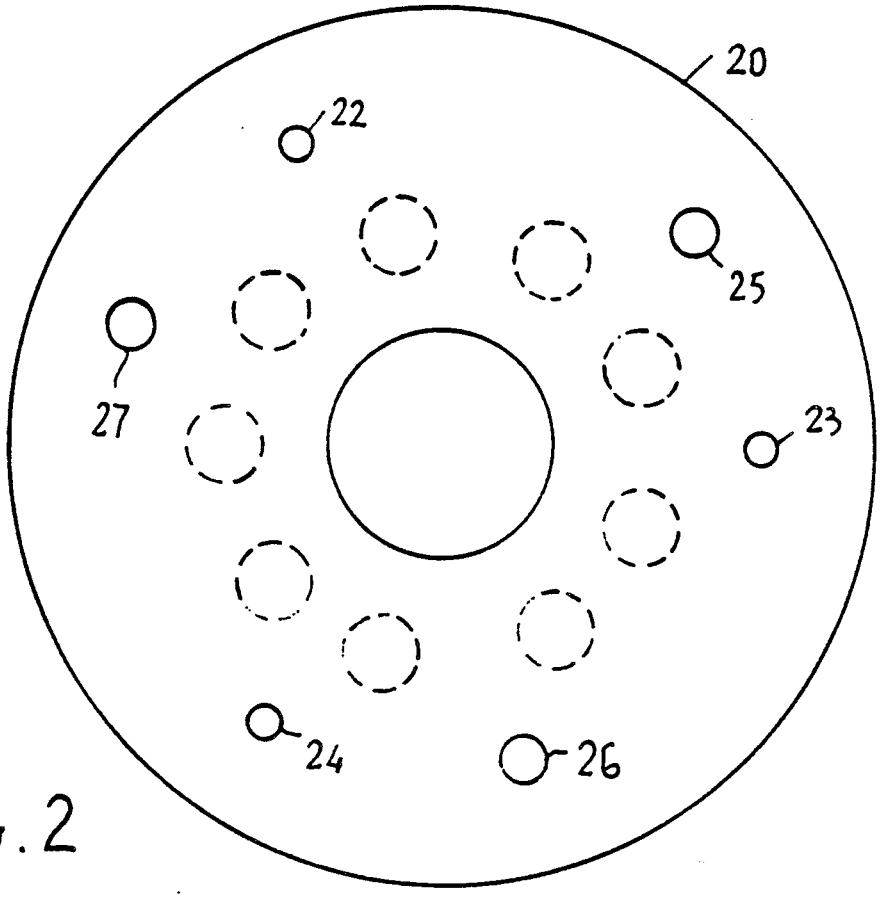

While FIG. 1 shows the multilayer element in section view, FIGS. 2 and 3 show in top view (with reference to FIG. 1) the intermediate polyester film 20 and the two protecting metal sheets 18, 19 respectively.

The polyester film 20 has the shape of a disc or circular corona having an outer diameter equal to the print head diameter and an inner radius less than the radial distance of the cores 4 from the print head axis.

The dotted lines indicate the zones of the film which are juxtaposed to the magnetic cores 4.

Three openings 22, 23, 24 are provided for insertion of adjusting pins which aid the mounting of the film in the print head.

Other openings 25, 26, 27 are provided for insertion of clamping screws, such as screws 13, 14 of FIG. 1.

It can be seen from FIG. 3 that the protecting metal sheets 18 and 19 have the same shape as the polyester film and corresponding openings for the adjustment pins and the clamping screws.

In addition the metal sheets 18 and 19 may have openings 28, 29, 30 which are circumferentially elongated, as shown in FIG. 3, or distributed on differing diameters or radii (as shown in FIG. 4) to increase the reluctance of the magnetic shunt and to adapt it to specific requirements, for instance in order to obtain a better magnetical decoupling among adjacent magnetic circuits, while still assuring the unity of each of the two elements 18, 19.

What is claimed is:

1. A needle printing head of the permanent magnet type, wherein a first circular ring of magnetic material is provided with a plurality of elastic leaves, the leaves extending inwardly toward a central axis of the print head, each leave being provided with a post and forming with said post one cantilever armature of a plurality of armatures for printing actuators, each armature having its post attracted towards a corresponding one of a plurality of magnetic poles magnetized by a permanent magnet, the needle printing head further having an actuator damping element, the magnetic damping element comprising:

first and second metal sheets, and a resilient film, the resilient film being interposed between between the first and second metal sheets, the first and second metal sheets and the resilient film being in the form of circular rings having the same outer diameter as the first circular ring and being interposed between the posts of the plurality of armatures and the plurality of magnetic poles, the first metal sheet being in contact with the poles and continuously in contact with the resilient film, and the resilient film being continuously in contact with the second metal sheet.

2. The needle printing head magnetic damping element of claim 1, wherein the first and second metal sheets have elongated openings for magnetically decoupling each of the poles from the contiguous poles.

* * * * *

UNITED STATES PATENT AND TRADEMARK OFFICE

CERTIFICATE OF CORRECTION

PATENT NO. : 4,995,742

DATED : February 26, 1991

INVENTOR(S) : Sergio Cattaneo

It is certified that error appears in the above-identified patent and that said Letters Patent is hereby corrected as shown below:

Title page, item [73], in the assignee, change "Bull HN Information Systems, Inc., Billerica, Mass. to --Bull HN Information Systems Italia S.p.A., Caluso, Italy--

Signed and Sealed this

Twenty-eighth Day of July, 1992

*Attest:*

DOUGLAS B. COMER

*Attesting Officer*

*Acting Commissioner of Patents and Trademarks*